US005134805A

United States Patent [19]

Frantzen et al.

[11] Patent Number: 5,134,805

[45] Date of Patent: Aug. 4, 1992

[54] FABRIC TREATMENT TENTER DEVICE WITH COUNTERBALANCED ROOF

[75] Inventors: Hermann Frantzen, Aachen; Karl Grafen, Wurselen; Dieter Jerusalem, Aachen; Kurt Mank, Alsdorf; Adolf Pütz, Aachen; Theo Schiffers, Wurselen; Bernd-Horst Schmitz, Stolberg; Hans Weber, Herzogenrath, all of Fed. Rep. of Germany

[73] Assignee: H. Krantz GmbH & Co., Aachen, Fed. Rep. of Germany

[21] Appl. No.: 791,850

[22] Filed: Nov. 14, 1991

[30] Foreign Application Priority Data

Dec. 4, 1990 [DE] Fed. Rep. of Germany ..... 4038567

[51] Int. Cl.[5] ..... E05F 1/10

[52] U.S. Cl. ..... 49/386; 16/1 C; 248/292.1

[58] Field of Search ..... 49/386; 38/17, 28, 33, 38/36, 43; 101/127.1; 16/1 C, 289; 248/280.1, 292.1; 267/229; 901/48

[56] References Cited

U.S. PATENT DOCUMENTS

| | | | |
|---|---|---|---|
| 1,870,894 | 8/1932 | Carn | 38/36 |
| 4,601 446 | 7/1986 | Opsahl | 49/386 X |
| 4,659,280 | 4/1987 | Akeel | 248/292.1 X |

FOREIGN PATENT DOCUMENTS

| | | | |
|---|---|---|---|
| 2475013 | 8/1981 | France | 49/386 |
| 2226361 | 6/1990 | United Kingdom | 49/386 |

*Primary Examiner*—Renee S. Luebke
*Assistant Examiner*—Jerry Redman
*Attorney, Agent, or Firm*—Mark T. Basseches

[57] ABSTRACT

A fabric tenter device having a pivotally mounted roof which may carry a nozzle box is provided with a counterbalance assembly enabling the roof and box to be pivotally shifted from the tenter covering to an open position by manual lifting forces. The counterbalance assembly is comprised of a lever divided into two arms, the lever being pivotally mounted on a fulcrum fixed to the tenter housing. The lever includes a weight arm underlying the roof and a power arm to the opposite side of the fulcrum. A chain having one end fixed to the power arm has its other end attached to a spring mechanism carried by the weight arm, the chain being arranged over a guide roller or rollers in such manner that the spring is tensioned to its maximum extent when the roof is in the tenter covering position.

6 Claims, 2 Drawing Sheets

FABRIC TREATMENT TENTER DEVICE WITH COUNTERBALANCED ROOF

BACKGROUND OF THE INVENTION

The invention relates to a device for compensating the weight of a roof portion to be lifted off the housing of a fabric tenter, which roof portion is connected with the housing via a swivel axis for opening and closing.

PRIOR ART

For purposes of maintenance, cleaning and repair of the inner components, it is necessary to open the roof portions of fabric tenters, where as a rule nozzle boxes are attached to the underside of the roof. The possibility of opening the roof portions is important also for quick cooling of the tenter if necessary.

To operate the roof portions of tenters the use of motor-driven spindles is generally known. A disadvantage is found to be that in the closed position of the roof, portions the spindles protrude high over the roof and thus are susceptible to being damaged.

From DE-PS 16 50 063 a device for the opening and closing of a pivotable roof portion is known, in which a drive cylinder whose piston, operated hydraulically or pneumatically, comprises a piston rod which articulately engages at a frame of the roof portion. In order that, in the closed position, all protruding parts can change over from a working position to an inactive position parallel to the roof portion plane without having to exert overly great forces, the drive cylinder is attached to the roof portion at its piston rod side end for rotation about a horizontal axis, and the piston rod is supported and guided by its free end in a concave guideway permanently connected with the frame. The guideway is curved and provided with a stop in such a way that when the piston is pressurized, the drive cylinder and the piston rod are first pivoted from an inactive position parallel to the roof plane about an angle of 90 degrees into an operating position. Only thereafter the roof portion is raised by means of the cylinder-piston rod unit.

Even though, due to the curved support of the piston rod end of the known apparatus, the cylinder can be brought into the desired horizontal inactive position without additional auxiliary means, the apparatus as a whole must be arranged above the roof portion and is thus still subject to the danger of being damaged.

A still more important disadvantage of the known apparatus and of all other known devices of this kind is the need for pneumatic, hydraulic or electromechanical means, which are costly in themselves and require the considerable expense of feed lines which must be maintained.

SUMMARY OF THE INVENTION

It is the object of the invention to provide a device for compensating the weight of the roof portion of a fabric tenter, which has the special feature of a simple construction requiring no maintenance and makes it possible to operate the roof portion—which due to its heaviness is in itself difficult to handle—without outside energy, even if a nozzle box is attached to the roof portion.

The object of the invention is achieved by providing the pivotable roof of a tenter device with a counterbalance assembly. The counterbalance is comprised of a lever mounted on a fulcrum fixed to the tenter frame for movement about a horizontal pivot axis. The lever includes a power arm disposed to one side of the fulcrum and a weight arm to the opposite side thereof. The power arm includes an articulation means, preferably a roller engaging a track or other undersurface portion of the roof. A spring assembly, preferably an elongate tubular housing having cup springs slidable therein is fixed to the power arm and slideably encompassed a rod shiftable within the housing such that when the rod is urged toward one end of the housing the springs are tensioned. A flexible pull member such as a chain or cable has one end secured to the rod and the other end secured to the weight arm, the pull member being arrayed over a guide roller fixed to the housing. The pull member is rigged such that when the roof is shifted from the raised open position to the closed tenter covering position the rod is retracted within the housing to progressively tension the springs, tension being greatest when the roof reaches the closed position.

Through the lifting means according to the invention, which is fully integrated inside the housing of the fabric tenter, it is possible to exert on the roof portion a lift force so adapted to the respective position thereof that operation of the roof portion can take place with little exertion of force entirely by hand. In fact, when the roof portion is in the horizontal position, the spring is under maximum initial tension and exerts on the pull element a force adapted for operation of the cover. When, having been unlocked, the roof portion gets increasingly into the open position, the initial tension of the spring decreases and exerts on the pull element a correspondingly reduced tensile force, which decreases proportionally as the force needed to pivot the roof to the open position decreases.

According to an especially advantageous embodiment of the invention the spring is composed of a number of cup springs which are mounted on a rod guided parallel to the weight arm, at whose end toward the power arm the chain type pull element engages.

The spring composed of a number of cup springs can be tensioned, at relatively short spring excursions, with an especially high force, so that minor changes in the effective length of the chain type pull element allow high weight compensations.

Lastly, an embodiment of the invention provides that the rod with the cup springs is lodged in a housing attached laterally of the weight arm, the rod end toward the power arm being passed through a closure piece of the housing wall and being mounted for displacement therein, while on the opposite end of the rod a pressure plate is attached, through which, upon axial displacement of the rod, the cup springs are tensionable more or less against the closure piece of the housing wall.

With this design it is possible to apply the cup springs and largely also the pull rod on the weight arm, protected in a preferably channel type housing, and in an especially advantageous manner also the weight arm itself may be hollow so as to function as the housing.

BRIEF DESCRIPTION OF DRAWINGS

A practical example of the device according to the invention is shown schematically in the drawings, in which.

DETAILED DESCRIPTION OF DRAWINGS

Figure 1:
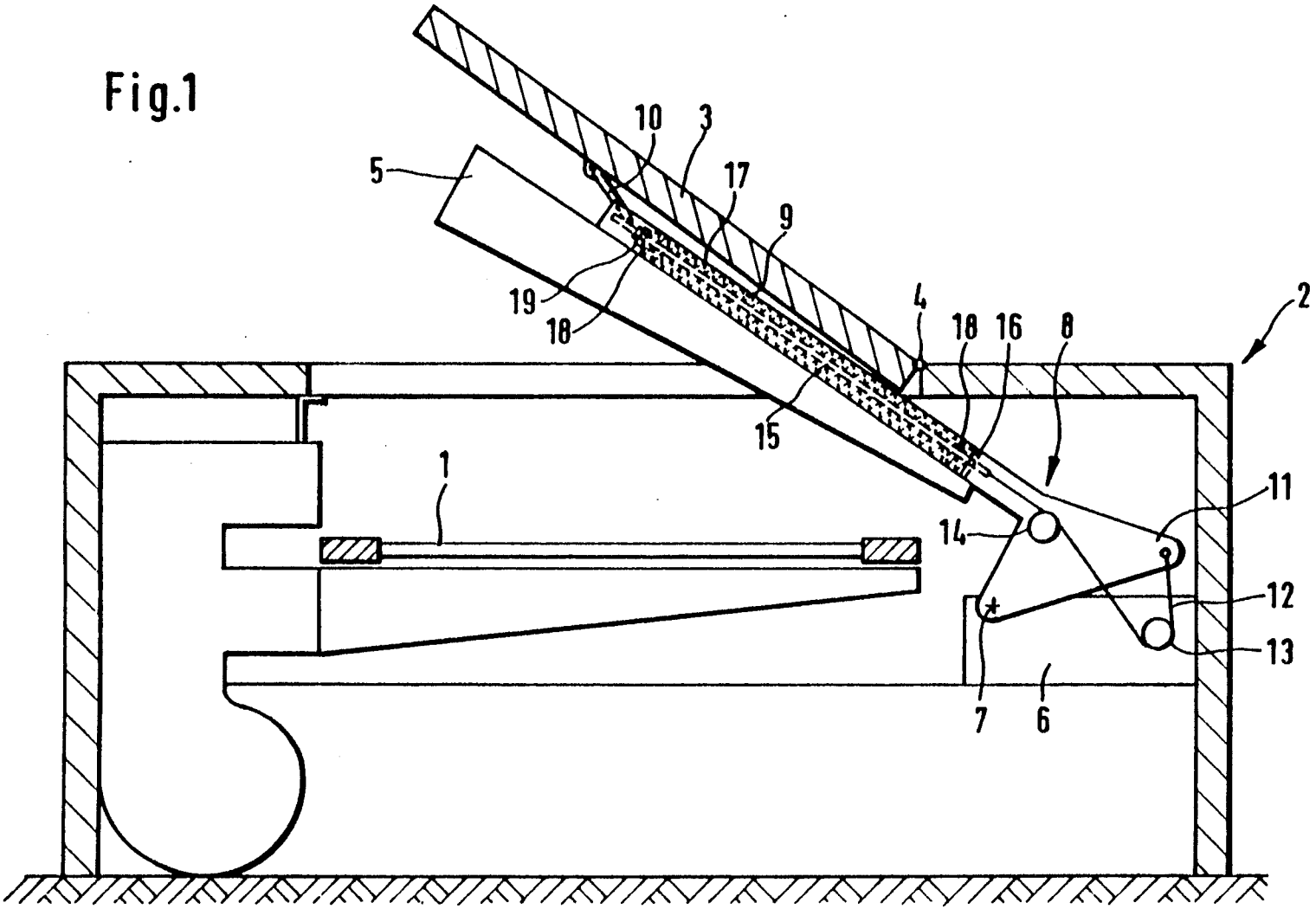
FIG. 1 shows a vertical transverse section through a fabric tenter equipped with a device according to the invention.

A fabric tenter, consisting of several fields succeeding each other in a conventional manner in running direction of a textile web 1, is enclosed by a housing 2, the interior of which is accessible from the roof side. To this end each field of the tenter is equipped with at least one roof portion 3, which is mounted for up and down pivoting about a swivel axis 4, the roof carrying an upper nozzle box 5.

Inside the housing 2, at a tenter frame 6, a two-armed lever 8 is pivotably mounted through a fulcrum 7. A weight arm 9 of lever 8 is connected at its free end with the roof portion 3 via an articulation piece 10, such as a roller running on a track or lower surface of the roof. A power arm 11 of lever 8 is connected at its free end with an end of a pull element 12 formed by a chain.

Figure 2:
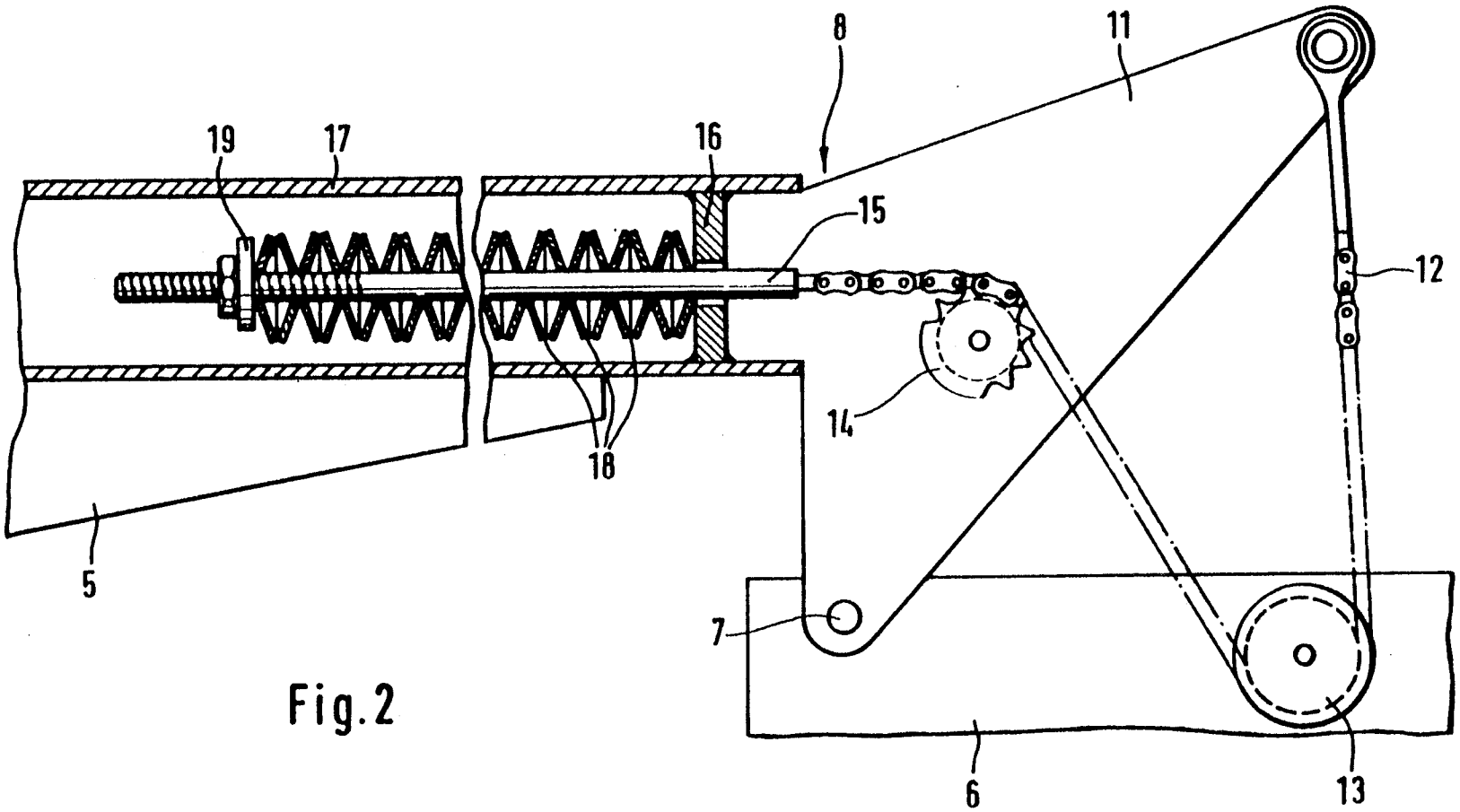
FIG. 2 a device shown broken off and partly in section, on a scale larger than FIG. 1.

The pull element 12 is guided over a guide roller 13 mounted on the tenter frame 6 and over a guide roller 14 mounted on lever 8 and is fastened at its other end to the end of a rod 15, as is shown in particular in FIG. 2.

Rod 15 is guided into the interior of the tenter housing 2 through an endside closure piece 16 of a tubular housing 17 fixed to or integrated with the weight arm 9. Inside the housing 17, on rod 15, a spring 18 formed by a cup springs slideable relative to the rod and housing is disposed, which is tensioned via a pressure plate 19, whose position is variable by means of a nut screwed onto a threaded pin of rod 15.

When the roof portion 3 is in horizontal closing position, the distance between the point of engagement of the pull cable 12 at the end of the power arm 11 and the guide roller 13 is greatest, so that the cup springs are given maximum tension and consequently the weight arm 9 strives to erect itself and thereby to swing the roof portion 3 into the open position. Due to this effect, a manual operation is possible for bringing the roof portion 3 from the closed position into the open position.

As the roof pivots upwardly, the forces required to effect further pivotal movement progressively decrease as do the counterbalancing forces exerted by the springs.

As will be apparent to skilled workers in the art familiarized with the instant disclosure, numerous variations in details of construction may be made without departing from the spirit of the invention which is thus to be broadly construed within the scope of the appended claims.

We claim:

1. In a fabric tenter device having a roof mounted to a tenter frame for pivotal movement about a horizontal pivot axis between a closed tenter covering position and an open tenter exposing position, a counterbalance assembly for facilitating upward pivotal movement of said roof from said tenter covering to said open position comprising a lever member, a fulcrum means on said frame for supporting said lever member for pivotal movement about a horizontal axis, said lever member including a weight arm disposed to one side and a power arm disposed to the other side of said fulcrum means, articulation means on an end portion of said weight arm at a position remote from said pivot axis for slidable engagement with an undersurface of said roof, an elongate tubular housing connected to said weight arm, a pull rod slideably guided in said housing for axial movement therein, spring means in said housing positioned to be tensioned responsive to movements of said rod toward a first end of said housing, a guide roller mounted on said tenter frame, a flexible pull member having first and second ends fixed respectively to said rod and to said power arm at a position displaced from said fulcrum, said pull member being arrayed over said guide roller such that said rod is progressively shifted toward said first end of said housing to thereby tension said spring means responsive to movements of said roof about said pivot axis from said open to said tenter covering position.

2. A device in accordance with claim 1 and including a second guide roller means on said power arm of said lever, said second guide roller means being disposed between said fulcrum and said second end of said pull member, said pull member being arrayed against said second guide roller means.

3. A device in accordance with claim 2 wherein said spring means comprises a plurality of cup springs slideably mounted in said housing, said springs slidably encircling said rod.

4. A device in accordance with claim 3 wherein said articulation means comprises a roller.

5. A device in accordance with claim 2 wherein said pull member comprises a cable or a chain.

6. A device in accordance with claim 1 wherein said weight arm is formed integrally with said housing.

* * * * *